US009737093B2

(12) United States Patent
Hon

(10) Patent No.: US 9,737,093 B2
(45) Date of Patent: Aug. 22, 2017

(54) ELECTRONIC CIGARETTE WITH SEALED CARTRIDGE

(71) Applicant: FONTEM HOLDINGS 1 B.V., Amsterdam (NL)

(72) Inventor: Lik Hon, North Point (HK)

(73) Assignee: Fontem Holdings 1 B.V., Amsterdam (NL)

( * ) Notice: Subject to any disclaimer, the term of this patent is extended or adjusted under 35 U.S.C. 154(b) by 285 days.

(21) Appl. No.: 14/523,525

(22) Filed: Oct. 24, 2014

(65) Prior Publication Data

US 2015/0040929 A1 Feb. 12, 2015

Related U.S. Application Data

(63) Continuation of application No. PCT/CN2012/000562, filed on Apr. 26, 2012.

(51) Int. Cl.
*A24F 47/00* (2006.01)

(52) U.S. Cl.
CPC ..... *A24F 47/008* (2013.01)

(58) Field of Classification Search
CPC ..... A24F 47/002; A24F 47/008; A61M 5/162
USPC ..... 329/131; 392/394
See application file for complete search history.

(56) References Cited

U.S. PATENT DOCUMENTS 3,721,240 A 3/1973 Tamburri
5,144,962 A 9/1992 Counts
6,715,494 B1 4/2004 McCoy
8,091,558 B2 1/2012 Martzel
8,813,759 B1 8/2014 Horian
2009/0126745 A1 5/2009 Hon
2010/0200008 A1 8/2010 Taieb
2010/0308481 A1 12/2010 Oglesby et al.
2011/0005535 A1 1/2011 Xiu
(Continued)

FOREIGN PATENT DOCUMENTS

CA 2641869 A1 5/2010
CN 101228969 A 7/2008
(Continued)

OTHER PUBLICATIONS

The State Intellectual Property Office, The P.R. China, The International Search Report and the Written Opinion issued in PCT International Application No. PCT/CN2012/000530 (Jan. 31, 2013).
(Continued)

*Primary Examiner* — Joseph S. Del Sole
*Assistant Examiner* — Mohamed K Ahmed Ali
(74) *Attorney, Agent, or Firm* — Kenneth H. Ohriner; Perkins Coie LLP

(57) ABSTRACT

In an electronic cigarette, separate cartridge and vaporizer units are provided. The cartridge unit may have a cartridge tube containing a liquid with a seal sealing the liquid within the cartridge tube. The vaporizer unit may have a piercer and a heater, with the front side of the vaporizer unit moveable into engagement with the cartridge unit, causing the piercer to pierce the seal in preparation for use of the electronic cigarette. A battery may be connected to a back side of the vaporizer unit. The vaporizer unit may also have and an electronic circuit electrically connected to the heater and to an inhalation sensor.

9 Claims, 6 Drawing Sheets

(56) References Cited

U.S. PATENT DOCUMENTS

| | | | | |
|---|---|---|---|---|
| 2011/0232654 | A1 | 9/2011 | Mass | |
| 2011/0303231 | A1 | 12/2011 | Li | |
| 2012/0204889 | A1 | 8/2012 | Xiu | |
| 2012/0279512 | A1* | 11/2012 | Hon | A24F 47/008 131/329 |
| 2013/0096509 | A1 | 4/2013 | Avery | |
| 2014/0209108 | A1 | 7/2014 | Li et al. | |

FOREIGN PATENT DOCUMENTS

| | | | | |
|---|---|---|---|---|
| CN | 201379072 | Y | 1/2010 | |
| CN | WO 2010091593 | A1 * | 8/2010 | A24F 47/008 |
| CN | 202052669 | U | 11/2011 | |
| CN | 102379458 | A | 3/2012 | |
| CN | 202197836 | U | 4/2012 | |
| DE | 102007011120 | A1 | 9/2008 | |
| EP | 2762019 | A1 | 8/2014 | |
| GB | 2466758 | B | 9/2011 | |
| JP | 2009537119 | | 10/2009 | |
| JP | 201187569 | | 5/2011 | |
| KR | 101011453 | | 1/2011 | |
| KR | 10-2012-0016167 | | 2/2012 | |
| WO | 2009155734 | A1 | 12/2009 | |
| WO | 2010-091593 | A1 | 8/2010 | |
| WO | 2010145805 | A1 | 12/2010 | |
| WO | 2011-131778 | A1 | 10/2011 | |
| WO | 2013040193 | A2 | 3/2013 | |

OTHER PUBLICATIONS

European Patent Office, Supplementary European Search Report issued in EP Patent Application No. EP 12875611.1 (Dec. 9, 2015).
The State Intellectual Property Office, The P.R. China, The International Search Report and the Written Opinion issued in International Application No. PCT/CN2012/000562 (Feb. 14, 2013).
Taiwan Patent Office, First Office Action issued in TW Application No. 102112938 (Jan. 13, 2016).
Japan Patent Office, Official Action issued in JP Application No. 2015-507319 (Jan. 18, 2016).
Taiwan Patent Office, First Office Action issued in TW Application No. 102112938 (Jan. 12, 2016).
Australian Patent Office, Patent Examination Report No. 1 issued in Australian Patent Application No. 2012378108 (Nov. 18, 2015).
Russian Federation Patent Office, Official Action issued in Russian Patent Application No. 2014147485 (Mar. 2, 2016).
IP Australia, "Patent Examination Report No. 2" issued in AU Patent Application No. 2012378108 (Oct. 20, 2016).
Canadian Intellectual Property Office, "Office Action" issued in CA Patent Application No. 2,870,469 (Apr. 8, 2016).
Chinese State Intellectual Property Office, "The First Office Action" issued in CN Patent Application No. 201280074222.7 (Apr. 15, 2016).
Chinese State Intellectual Property Office, "The Second Office Action" issued in CN Patent Application No. 201280074222.7 (Oct. 25, 2016).
Japanese Patent Office, "Office Action" issued in JP Patent Application No. 2015-507319 (Sep. 5, 2016).
Korean Intellectual Property Office, "Notice of Preliminary Rejection" issued in KR Patent Application No. 10-2014-7033100 (Jun. 14, 2016).

* cited by examiner

ELECTRONIC CIGARETTE WITH SEALED CARTRIDGE

CROSS REFERENCE TO RELATED APPLICATIONS

This application is a continuation of International Application No. PCT/CN2012/000562, filed Apr. 26, 2012 which is incorporated herein by reference.

BACKGROUND OF THE INVENTION

Electronic cigarettes or vapor inhalers generally use a heater to vaporize liquid nicotine, or other liquid substances. The user inhales on the electronic cigarette drawing ambient air through the electronic cigarette housing. The vapor or mist mixes with the air flow moving through the housing and is inhaled by the user.

In comparison to real tobacco cigarettes, electronic cigarettes have many advantages. The risks of lung cancer associated with real tobacco cigarettes is largely avoided with electronic cigarettes because the tar and other chemicals in tobacco linked to lung cancer are not present in an electronic cigarette. Electronic cigarettes generate vapor or mist, and not smoke. Consequently, there is no comparable second-hand smoke problem with use of electronic cigarettes. In addition, since there is no burning material in electronic cigarettes, the risk of fire is eliminated.

The liquid in electronic cigarettes is stored in a bottle or in absorbent material within the housing. During storage and handling, the liquid may leak due to vibration, temperature variations, and other factors. The liquid may also be negatively affected by exposure to the environment. Accordingly, there is a need for an improved electronic cigarette.

SUMMARY OF THE INVENTION

In a new electronic cigarette, separate cartridge and vaporizer units are provided. The cartridge unit has a cartridge tube containing a liquid with a seal sealing the liquid within the cartridge tube. The vaporizer unit may have a piercer and a heater, with the front side of the vaporizer unit moveable into engagement with the cartridge unit, causing the piercer to pierce the seal in preparation for use of the electronic cigarette. A battery may be connected to a back side of the vaporizer unit via a connector. The vaporizer unit may also have and an electronic circuit electrically connected to the heater and to an inhalation sensor, or a switch activated by the user.

BRIEF DESCRIPTION OF THE DRAWINGS

In the drawings, the same reference number indicates the same element in each of the views.

DETAILED DESCRIPTION

Figure 1:
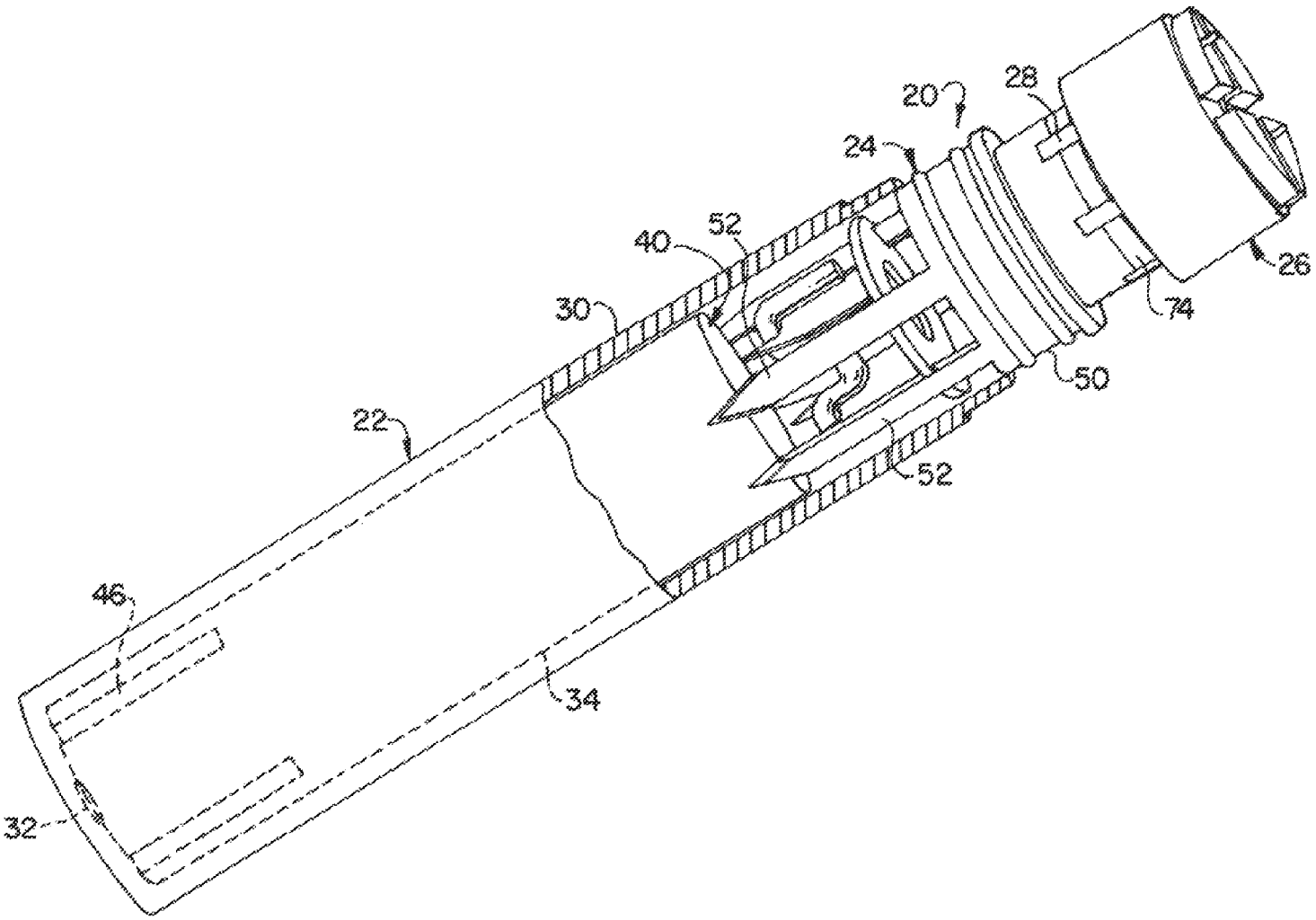
FIG. 1 is a perspective view of a new electronic cigarette.
Figure 2:
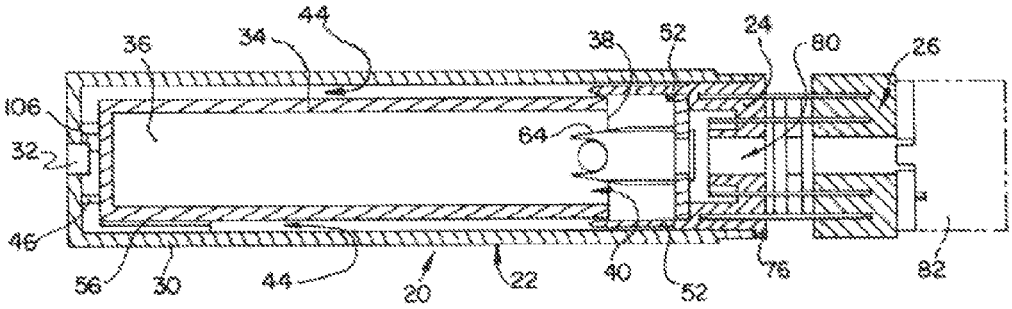
FIG. 2 is a section view of the electronic cigarette shown in FIG. 1.
Figure 3:
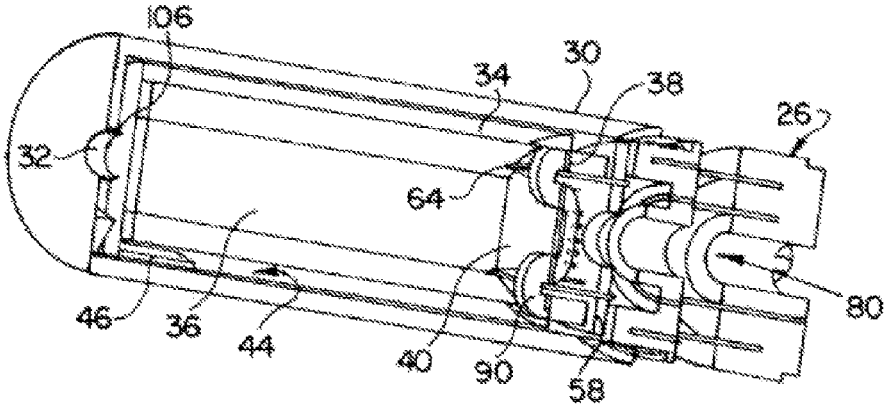
FIG. 3 is a perspective section view of the electronic cigarette shown in FIG. 1.

As shown in FIG. 1 an electronic cigarette 20 has a cartridge unit 22, a vaporizing unit 24 and a connector 26. As shown in FIGS. 1-3, the cartridge unit 22 includes an overtube 30 having an outlet 32 at the front end. A cartridge tube 34 within the overtube 30 has a closed front end and an open back end 40. Fiber material 36 containing a liquid, such as liquid nicotine, is sealed within the cartridge tube 34 by a foil or membrane seal 38 at the back end of the cartridge tube 34. The closed front end of the cartridge tube may be spaced apart from the front wall of the overtube 30 by standoffs 46.

Figure 7:
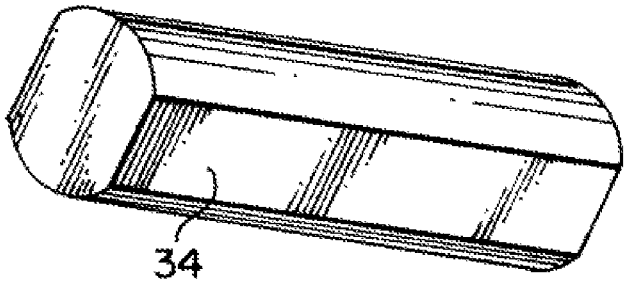
FIG. 7 in a perspective view of the cartridge tube shown in FIGS. 1-3.

As shown in FIGS. 2 and 3, a flow path 44 is formed between the cartridge tube 34 and the over tube 30. As shown in FIG. 7, the cartridge tube may have flat sides so that crescent shaped flow paths are formed between the cartridge tube 34 and the over tube 34 when the cartridge tube is inserted into the over tube. Alternatively, various other cartridge tube shapes may be used to provide one or more flow paths between the cartridge tube and the over tube. Although the Figures show the cartridge tube 34 centered within the overtube 30, in some designs, it may also be offset to one side. Inserts or baffles may also be used inside the overtube to create various other flow path shapes and configurations.

Figure 4:
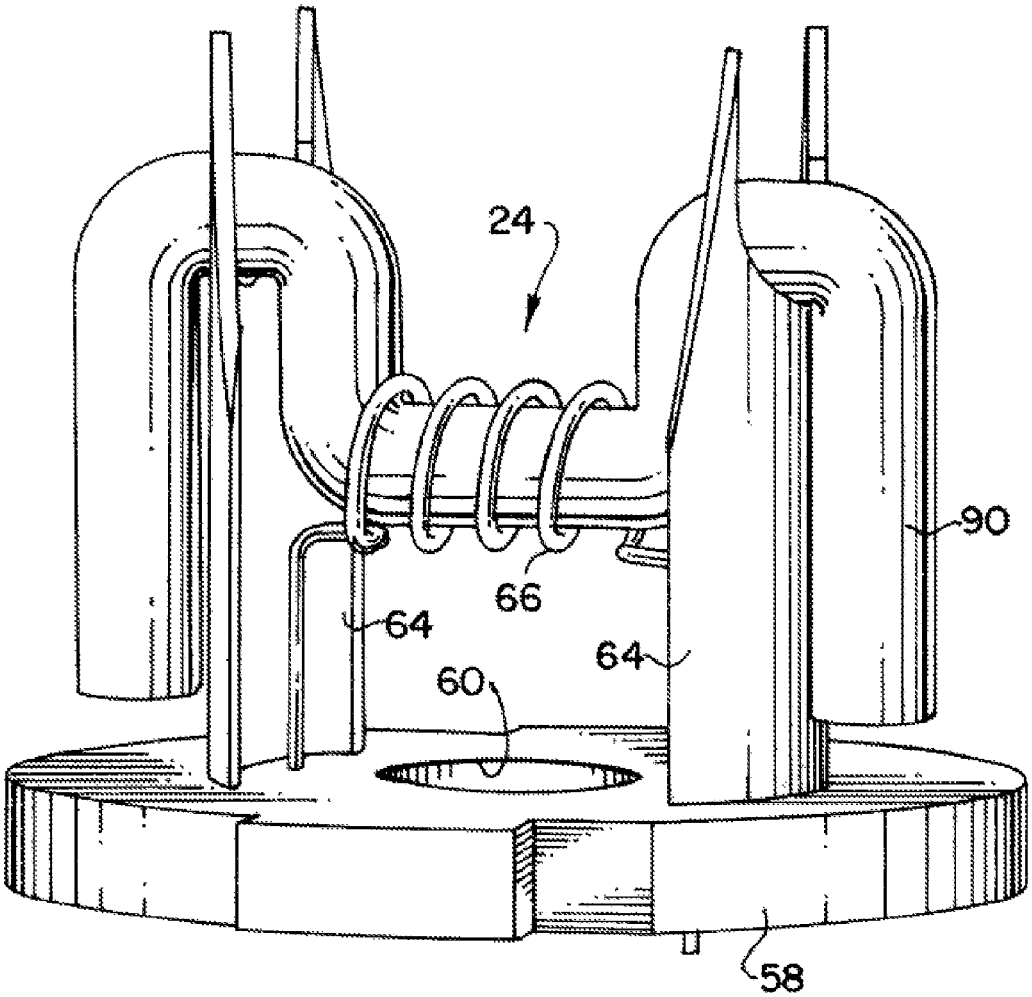
FIG. 4 is an enlarged perspective view of the vaporizer assembly shown in FIGS. 1-3.
Figure 5:
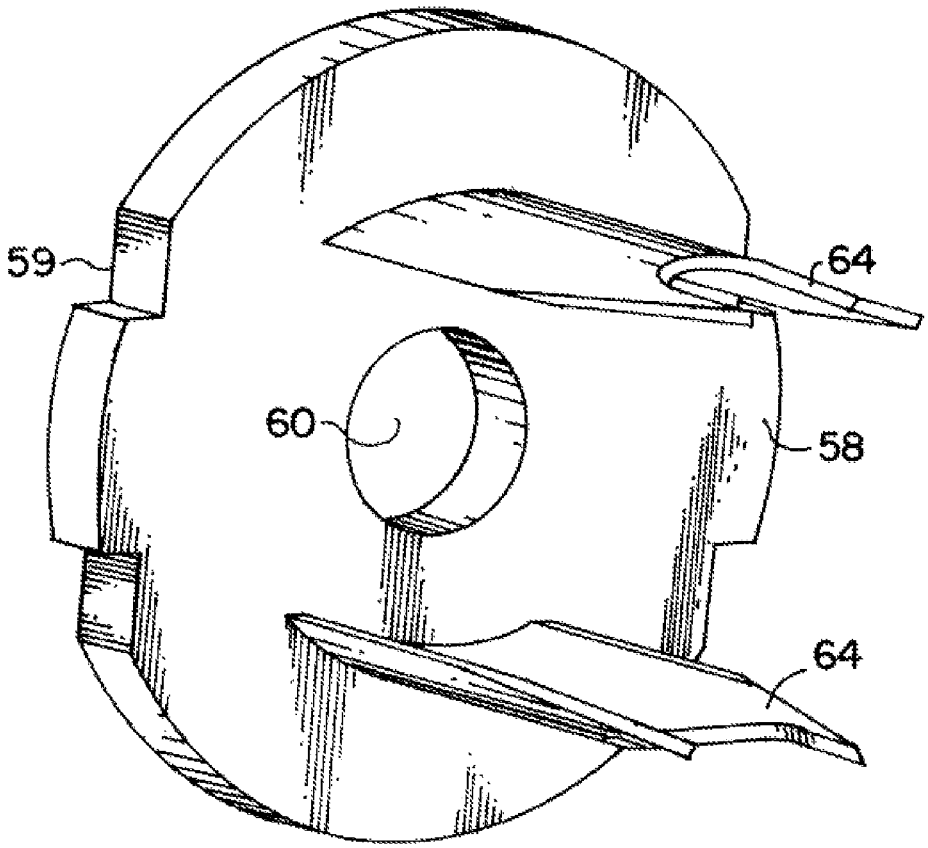
FIG. 5 is an enlarged perspective view of the vaporizer plate shown in FIG. 4.
Figure 6:
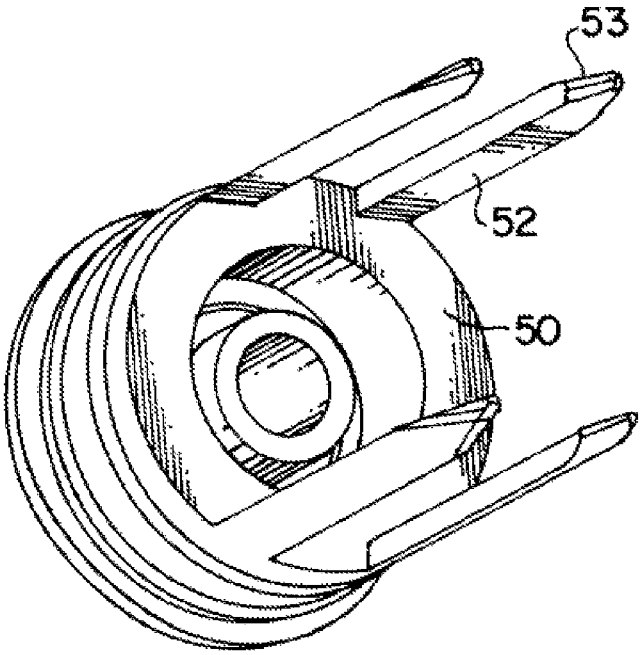
FIG. 6 is an enlarged perspective view of the arm base shown in FIGS. 1 and 3.

Turning to FIGS. 4 and 5, the vaporizing unit 24 may have one or more piercing blades 64 attached to a plate 58 having a through hole 60. A heater tube 90 may be supported on cutouts in the blades 64. The heater tube may be made of quartz fiber, or other high temperature resistant wicking or absorbent material. A central section of the heater tube 90 extends within a heater coil 66. As shown in FIGS. 1-3, 6 and 8, arms 52 are attached to the front side of an arm base 50, with socket slots 54 on the back side of the arm base 50. The tips of the arms are tapered into wedges 53. The design shown has four arms, although more or less arms may be provided as well. With the plate 58 assembled onto the arm base 50, the arms 52 may lie in recesses 59 in the plate 58, with the through hole 60 in the plate aligned with a corresponding through hole in the arm base 50. The wire lead of the heating coil 66 may connect to a circuit board or electronic chip directly or indirectly. It is also possible to connect the ends of the heating coil 66 to the blades 64, and with the blades electrically connected to the circuit board or electronic chip, which may be included in or on the plate 58, or located at another position within electronic cigarette 20.

Figure 8:
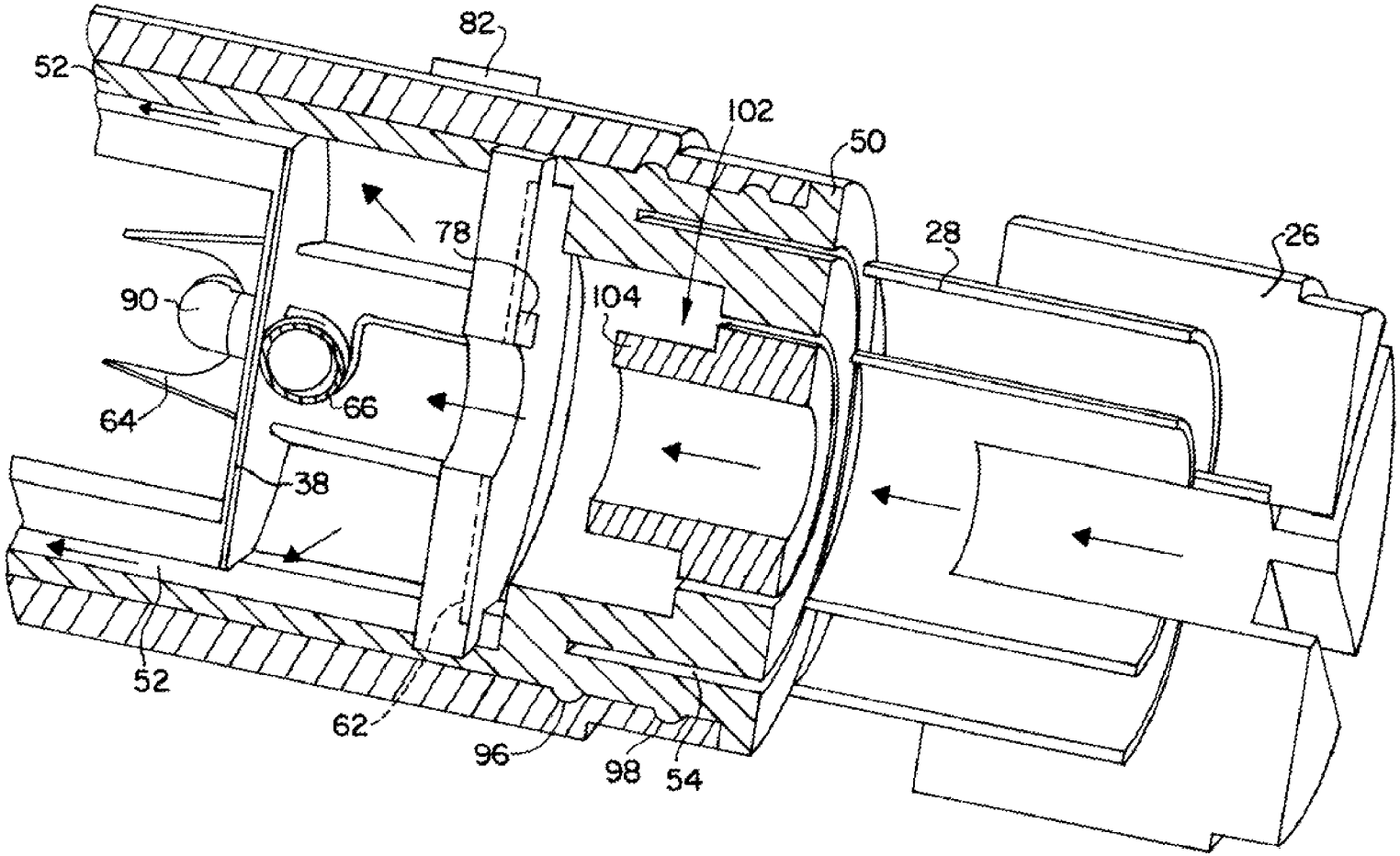
FIG. 8 is a perspective section view showing the arm base of FIG. 6 positioned in the over tube of FIGS. 1-3, in a ready-to-use position.

As shown in FIGS. 1 and 8, the connector 26 may have rings 28 that can plug into the slots 54 on the back side of the arm base 50. Alternatively, the connector 26 may screw or snap onto the vaporizing unit 24. The back end of the connector 26 is adapted to receive or plug into a battery 82.

As shown in FIG. 8, the arm base 50 has first and second spaced apart detent rings 96 and 98 adapted to snap into first and second semicircular grooves at the back end of the arm base. In the first detent position, the detent ring 96 is in the outer groove, closest to the back end of the arm base 50. In this position, the blades 64 are held away from the seal 38 on the cartridge tube 34. The electronic cigarette 20 is provided from the factory in this position. Consequently, the cartridge tube 34 remains sealed during shipping and storage. This avoids any leaking or evaporation of liquid, for example nicotine solution, from the cartridge tube during shipping and storage. In addition, since the detent ring 96 firmly holds the arm base in position on the over tube 30, the seal 38 remains intact even with the vibration and shock impulses that typically occur during shipping and handling.

Turning once again to FIGS. 1-3 and 8, when ready for use, the arm base 50 is pushed forward into the over tube 30, causing it to move into the position shown in FIG. 8. During this movement, the first detent ring 96 moves from the outer groove into the inner groove. The optional second detent ring 98, previously outside of the over tube 30, correspondingly moves into the outer groove. This longitudinal movement of the arm base 50 drives the front end of vaporizing unit 24 through the seal 38, with the heater tube 90 moving into the cartridge tube 34, as shown in FIG. 8. The spacing between the outer groove and the inner groove consequently determine the depth of insertion of the heater tube 90 into the fiber core 36 of the cartridge tube 34.

When the arm base 50 is pushed forward into the over tube 30, as described above, the wedge ends 53 on the arms move between the cartridge tube 34 and the inner walls of the over tube 30, to firmly hold the cartridge tube in place. At the same time, the blades 64 pierce and cut through the seal 38 and the heater tube 90 moves by the pre-set distance into the cartridge tube. As shown in FIG. 8. the heater tube 90 is then in direct contact with the liquid filled or liquid impregnated core 36 of the cartridge tube 34. Liquid from the core 36 wicks or otherwise moves into or onto the heater tube 90.

As shown in FIG. 8, the arm base 50 may include an annular ring chamber 102 around a chamber tube 104. After the seal is pierced, any liquid leaking out of the cartridge tube may collect in the ring chamber 102, rather than travel back through the chamber tube 104 to the battery. Similarly, as shown in FIG. 2, an annular liquid barrier 106 may be provided around the inlet 32 on the inner wall of the front end of the over tube 30, to help prevent any liquid from moving out of the inlet 32.

A battery is attached onto the connector 26, either before or after the forward piercing movement. The battery is electrically connected to the circuit board 62 via the metal rings on the connector 26 plugging into the sockets 54 having leads to the circuit board 62.

The user inhales on the front end of the overtube 30, drawing air out of the outlet 32. Air flows through the continuous central opening in the connector 26 and in the vaporizing unit 24. A sensor 78 shown in FIG. 8, either on or electrically connected to the circuit board 62, may be used to detect air flow through the central passageway in the vaporizing unit 24. Upon detection of air flow, the circuit board 62 switches on electric current to the heater coil 66. Alternatively, as shown in FIG. 8, a manual switch 82 may be provided on base, with the user activating the switch to turn the heater on while the user is inhaling. Liquid from the cartridge tube 34 is vaporized and mixed with the flowing air. The mixture of vapor and/or mist and air moves forward through the flow path 44, through the outlet 32, and is inhaled by the user.

As shown in FIG. 3, there is no opening at the front end of the cartridge tube 34. Accordingly, air cannot flow through the cartridge tube. Rather, upon inhalation, as shown by the arrows in FIG. 8, air flows through the vaporizing unit 24, but not through the cartridge tube 34. This makes the electronic cigarette 20 much more resistant to liquid leaking resulting from blowing into the outlet. In many existing designs, if the user blows into the outlet, instead of inhaling, liquid leaking may increase dramatically. With the present design, however, blowing into the outlet does not cause any great increase in leaking, because it does not create any positive pressure acting to push liquid out of the cartridge tube.

The cartridge tube 34 may be filled with a liquid saturated fiber or sponge-like or porous material, or another material capable of holding liquid. The arm base 50 and the electrical contacts 74 on the back of the arm base may be copper or other electrically conductive metal. The arm base 50 and may also be made of plastic or ceramic, with separate wire leads provided to make electrical connections. The blades 64 or other piercer may be metal, such as stainless steel, another metal, or a non-metal material such as plastic. A single blade or pointed piercer may be used. Optionally, the blades or piercer may be replaced by a projection on the heater tube 90, if used, or on the heater 66.

The blades 64 may optionally be attached to the arms 52, instead of the plate 58. The heater coil 66 may be a coil of wire, or other form of electrical heater, including heater wires in non-coil configurations. The seal 38 may be a metal foil seal, or a seal of other material, such as plastic. The circuit board 62 may be replaced with an electronic chip or component package.

The cartridge unit 22, the vaporizing unit 24 and the connector 26 may be provided as separate units, or together in an un-assembled kit. With the cartridge unit 22 separate from the vaporizing unit 24, the seal 38 is intact and seals the liquid within the cartridge tube 34. This avoids leaking during storage and handling. The seal also seals the liquid from the environment, which may increase the storage life of the liquid. The vaporizing unit 24 is designed for repeated use, while the cartridge unit 22 is a consumable single use unit. By providing the cartridge unit 22 and the vaporizing unit 24 as separate units, the user can reuse the vaporizing unit 24 over and over again, while replacing the cartridge unit 22 as needed. The electronic cigarette 20 can therefore be provided at lower cost.

Thus, novel designs have been shown and described. Various changes and substitutions may of course be made without departing from the spirit and scope of the invention. The invention, therefore, should not be limited, except by the following claims and their equivalents.

The invention claimed is:

1. An electronic cigarette, comprising:

a cartridge unit including cartridge tube containing a liquid, and a seal on the cartridge tube sealing the liquid within the cartridge tube; and a vaporizer unit having a piercer and a heater comprising a fiber heater tube supported by spaced apart blades and a wire coil around the heater tube, and a hole between the spaced apart blades with the hole aligned with the wire coil;

with the vaporizer unit moveable into engagement with the cartridge unit, causing the piercer to pierce the seal.

2. The electronic cigarette of claim 1 further comprising a battery connected to the vaporizer unit.

3. The electronic cigarette of claim 1 with the vaporizer unit further including an electronic circuit electrically connected to the heater and to an inhalation sensor.

4. The electronic cigarette of claim 3 with the piercer at a tip of one or more of the blades.

5. The electronic cigarette of claim 4 with the vaporizer unit including arms attached to a base, with the arms having wedging tips for engaging the cartridge unit.

6. The electronic cigarette of claim 3 with the vaporizer unit having a base, with the piercer and the heater on a front side of the base, and a connector on the back side of the base, with the connector adapted to connect with the electronic circuit.

7. The electronic cigarette of claim 5 with the cartridge tube inside of an overtube and a flow path formed between the cartridge tube and the overtube, with the flow path leading to an outlet at a front end of the over tube.

8. The electronic cigarette of claim 7 further including a chamber tube extending into a ring chamber in the arm base, for trapping liquid.

9. An electronic cigarette, comprising:

a cartridge unit including cartridge tube containing a liquid, and a seal on the cartridge tube sealing the liquid within the cartridge tube;

a vaporizer unit having an electronic circuit electrically connected to an inhalation sensor and to a battery; spaced apart blades on a first side of a base, and an electrical connector on a second side of the base; a piercer on a tip of one or more of the spaced apart blades; a heater comprising a fiber heater tube supported by the spaced apart blades with a wire coil around the heater tube and electrically connected to the electronic circuit via the electrical connector; and a hole through the base aligned with the wire coil;

with the vaporizer unit moveable into engagement with the cartridge unit, causing the piercer to pierce the seal, and with the wire coil vaporizing the liquid.

* * * * *